US006427260B1

(12) United States Patent
Osborne-Kirby

(10) Patent No.: US 6,427,260 B1
(45) Date of Patent: Aug. 6, 2002

(54) FAUCET THERMAL MONITORING SYSTEM

(76) Inventor: Richard C. Osborne-Kirby, Ashbarton Potten End Hill Water End, Hemel Hempstead, Hertfordshire HP1 3BN (GB)

( * ) Notice: Subject to any disclaimer, the term of this patent is extended or adjusted under 35 U.S.C. 154(b) by 0 days.

(21) Appl. No.: 09/751,735

(22) Filed: Dec. 29, 2000

(51) Int. Cl.[7] ..... E03C 1/04

(52) U.S. Cl. ..... 4/678; 4/675; 236/94; 374/148

(58) Field of Search ..... 4/567, 598, 605, 4/615, 675–678; 236/12.12, 94; 374/147, 148

(56) References Cited

U.S. PATENT DOCUMENTS

| | | | | |
|---|---|---|---|---|
| D251,547 | S | | 4/1979 | Mcloed |
| 4,638,828 | A | * | 1/1987 | Barrineau et al. ..... 137/62 |
| 4,773,767 | A | * | 9/1988 | Coll ..... 116/217 |
| 5,199,790 | A | | 4/1993 | Pawelzik et al. |
| 5,265,959 | A | * | 11/1993 | Meltzer ..... 137/551 |
| 5,304,003 | A | | 4/1994 | Winninger |
| 5,320,137 | A | * | 6/1994 | Huang ..... 374/147 |
| 5,542,449 | A | | 8/1996 | Huang |
| 5,667,305 | A | | 9/1997 | Walker |
| 5,738,442 | A | | 4/1998 | Paron et al. |
| 5,794,282 | A | * | 8/1998 | Lucas et al. ..... 4/605 |
| 5,915,415 | A | * | 6/1999 | Huang ..... 137/551 |

FOREIGN PATENT DOCUMENTS

| | | | | |
|---|---|---|---|---|
| JP | 8-296260 | A | * 12/1996 | ..... 4/678 |

* cited by examiner

*Primary Examiner*—Gregory Huson
*Assistant Examiner*—Tuan Nguyen

(57) ABSTRACT

A faucet thermal monitoring system for verifying the temperature of water being delivered through a faucet. The faucet thermal monitoring system includes a housing which is couplable to a spout of a faucet and thermally conductive such that heat is conducted between water flowing through the spout and the housing and a liquid crystal temperature panel coupled to the housing providing a visual indication of the temperature of the water flowing through the tap.

5 Claims, 2 Drawing Sheets

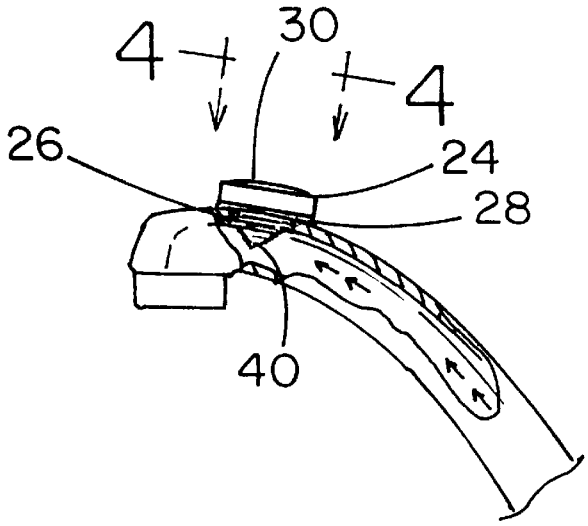
FIG. 3
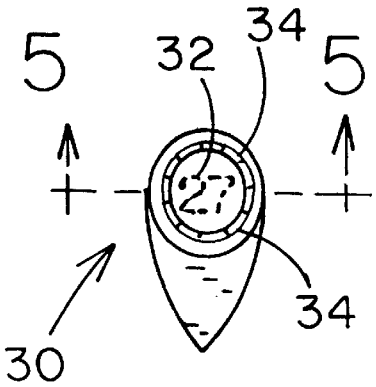
FIG. 4
FIG. 5
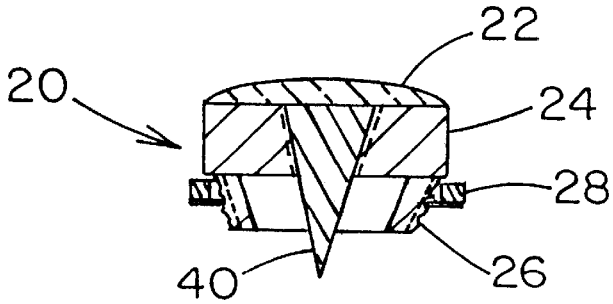

FAUCET THERMAL MONITORING SYSTEM

BACKGROUND OF THE INVENTION

1. Field of the Invention

The present invention relates to thermometers and more particularly pertains to a new faucet thermal monitoring system for verifying the temperature of water being delivered through a faucet.

2. Description of the Prior Art

The use of thermometers is known in the prior art. More specifically, thermometers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,542,449; U.S. Pat. No. 5,199,790; U.S. Pat. No. 5,667,305; U.S. Pat. No. 5,738,442; U.S. Pat. No. 5,304,003; and U.S. Pat. No. Des. 251,547.

While these devices fulfill their respective, particular objectives and requirements, the aforementioned patents do not disclose a new faucet thermal monitoring system. The inventive device includes

- a housing which is couplable to a spout of a faucet and thermally conductive such that heat is conducted between water flowing through the spout and the housing and a liquid crystal temperature panel coupled to the housing providing a visual indication of the temperature of the water flowing through the tap.

In these respects, the faucet thermal monitoring system according to the present invention substantially departs from the conventional concepts and designs of the prior art, and in so doing provides an apparatus primarily developed for the purpose of verifying the temperature of water being delivered through a faucet.

SUMMARY OF THE INVENTION

In view of the foregoing disadvantages inherent in the known types of thermometers now present in the prior art, the present invention provides a new faucet thermal monitoring system construction wherein the same can be utilized for verifying the temperature of water being delivered through a faucet.

The general purpose of the present invention, which will be described subsequently in greater detail, is to provide a new faucet thermal monitoring system apparatus and method which has many of the advantages of the thermometers mentioned heretofore and many novel features that result in a new faucet thermal monitoring system which is not anticipated, rendered obvious, suggested, or even implied by any of the prior art thermometers, either alone or in any combination thereof.

To attain this, the present invention generally comprises a housing which is couplable to a spout of a faucet and thermally conductive such that heat is conducted between water flowing through the spout and the housing and a liquid crystal temperature panel coupled to the housing providing a visual indication of the temperature of the water flowing through the tap.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new faucet thermal monitoring system apparatus and method which has many of the advantages of the thermometers mentioned heretofore and many novel features that result in a new faucet thermal monitoring system which is not anticipated, rendered obvious, suggested, or even implied by any of the prior art thermometers, either alone or in any combination thereof.

It is another object of the present invention to provide a new faucet thermal monitoring system which may be easily and efficiently manufactured and marketed.

It is a further object of the present invention to provide a new faucet thermal monitoring system which is of a durable and reliable construction.

An even further object of the present invention is to provide a new faucet thermal monitoring system which is susceptible of a low cost of manufacture with regard to both materials and labor, and which accordingly is then susceptible of low prices of sale to the consuming public, thereby making such faucet thermal monitoring system economically available to the buying public.

Still yet another object of the present invention is to provide a new faucet thermal monitoring system which provides in the apparatuses and methods of the prior art some of the advantages thereof, while simultaneously overcoming some of the disadvantages normally associated therewith.

Still another object of the present invention is to provide a new faucet thermal monitoring system for verifying the temperature of water being delivered through a faucet.

Yet another object of the present invention is to provide a new faucet thermal monitoring system which includes a housing which is couplable to a spout of a faucet and thermally conductive such that heat is conducted between water flowing through the spout and the housing and a liquid crystal temperature panel coupled to the housing providing a visual indication of the temperature of the water flowing through the tap.

Still yet another object of the present invention is to provide a new faucet thermal monitoring system that reduces the chances of being scalded by hot water flowing from a faucet.

Even still another object of the present invention is to provide a new faucet thermal monitoring system that is environmentally friendly be allowing the user to reduce the unnecessary use of hotter than desired water usage.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a schematic side view of an embodiment of the present invention.

FIG. 4 is a schematic top view of the housing of an embodiment of the present invention taken along line 4—4 of FIG. 3.

FIG. 5 is a schematic cross-sectional view of the hosing of an embodiment of the present invention taken along line 5—5 of FIG. 4.

DESCRIPTION OF THE PREFERRED EMBODIMENT

Figure 1:
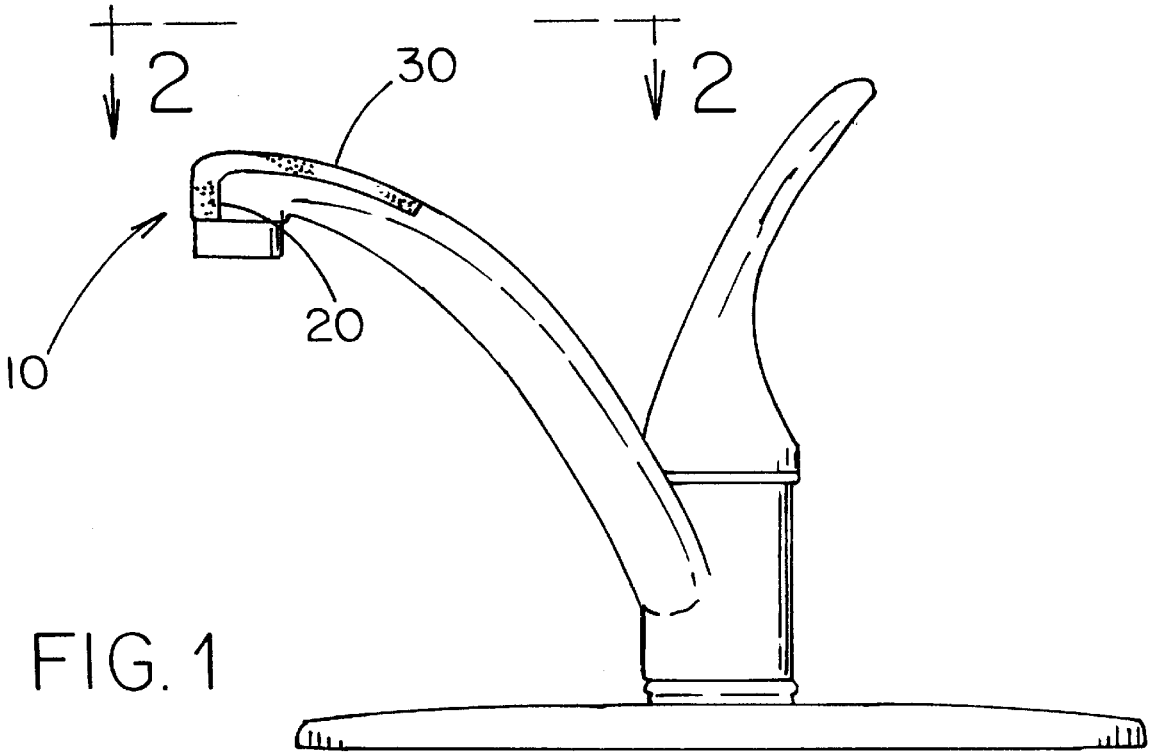
FIG. 1 is a schematic perspective view of a new faucet thermal monitoring system according to the present invention.
Figure 2:
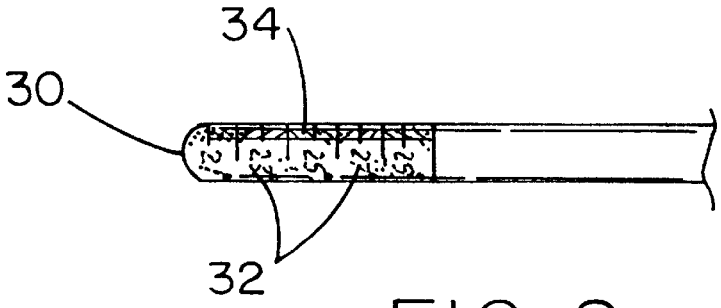
FIG. 2 is a schematic top view of the present invention.

With reference now to the drawings, and in particular to FIGS. 1 through 5 thereof, a new faucet thermal monitoring system embodying the principles and concepts of the present invention and generally designated by the reference numeral 10 will be described.

As best illustrated in FIGS. 1 through 5, the faucet thermal monitoring system 10 generally comprises an housing 20 and a liquid crystal temperature strip 30.

The housing 20 can be coupled to a spout of a faucet. The housing 20 is thermally conductive such that heat is conducted between water flowing through the spout and the housing 20.

The liquid crystal temperature panel 30 is coupled to the housing 30. The liquid crystal temperature panel 30 provides a visual indication of the temperature of the water flowing through the tap.

In an embodiment the housing 20 is an integral portion of the spout.

In a further embodiment the liquid crystal temperature panel 30 further comprises a plurality of indicator bands 34. Each one of the plurality of indicator bands 34 becomes visible when heat transferred between the water and the housing 20 exceeds a predetermined limit.

In yet a further embodiment each one of the plurality of indicator bands 34 has a unique color designation corresponding to the predetermined limit.

In still a further embodiment the liquid crystal temperature panel 30 further comprises a plurality of numeric indicia 32. Each one of the plurality of numeric indicia 32 corresponds to the predetermined limit.

In an embodiment the housing 20 further comprises a top wall 22, a perimeter side wall 24, a conically threaded portion 26 and a washer member 28. The liquid crystal temperature strip 30 is positioned substantially on an exterior surface of the top wall 22. The perimeter side wall 24 extends downwardly from the top wall 22. The conical threaded portion 26 extends downwardly and inwardly from a bottom edge of the perimeter wall 24. The conical threaded portion 26 is substantially self-tapping. The conical threaded portion 26 is designed for penetrating the spout of a faucet, such that an interior of the housing 20 is in environmental communication with an interior of the spout. The washer member 28 is designed for providing an environmental seal between the interior of the spout and an external surface of the perimeter side wall 24.

In a further embodiment the housing 20 further comprises a temperature sensing tip 40 designed for conducting heat from the water flowing through the spout to a the top wall 22.

In use, the faucet thermal monitoring system is coupled to the spout of a faucet. The faucet can then be used in the conventional manner with the added benefit of a visible indication of the temperature of the water flowing through the spout.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A faucet thermal monitoring system comprising:

a housing adapted for threadedly coupling to a spout of a faucet;

a liquid crystal temperature panel coupled to said housing, said liquid crystal temperature panel providing a visual indication of the temperature of the water flowing through the faucet;

said housing having a top wall, perimeter side wall, conical threaded portion and a washer member;

said liquid crystal temperature strip being positioned substantially on an exterior surface of said top wall;

said perimeter side wall extending downwardly from said top wall;

said conical threaded portion extending downwardly and inwardly from a bottom edge of said perimeter wall, said conical threaded portion being substantially self-tapping, said conical threaded portion being adapted for penetrating the spout of a faucet, such that an interior of said housing is in environmental communication with an interior of the spout;

said washer member adapted for providing an environmental seat between the interior of the spout and an external surface of said perimeter side wall; and a temperature sensing tip adapted for conducting heat from the water flowing through the spout to a said top wall.

2. The faucet thermal monitoring system of claim 1, wherein said liquid crystal temperature panel further comprises:

a plurality of indicator bands, each one of said plurality of indicator bands becoming visible when heat transferred between the water and said housing through said temperature sensing tip exceeds a predetermined limit.

3. The faucet thermal monitoring system of claim 2, wherein each one of said plurality of indicator bands having a unique color designation corresponding to said predetermined limit.

4. The faucet thermal monitoring system of claim 1, wherein said liquid crystal temperature panel further comprises:

a plurality of numeric indicia, each one of said plurality of numeric indicia corresponding to a predetermined limit.

5. A faucet thermal monitoring system comprising:

a housing couplable to a spout of a faucet, said housing being thermally conductive such that heat is conducted between water flowing through the spout and said housing;

a liquid crystal temperature panel coupled to said housing, said liquid crystal temperature panel providing a visual indication of the temperature of the water flowing through the faucet;

wherein said housing further comprises:

a top wall, said liquid crystal temperature strip being positioned substantially on an exterior surface of said top wall;

a perimeter side wall extending downwardly from said top wall;

a conical threaded portion extending downwardly and inwardly from a bottom edge of said perimeter wall, said conical threaded portion being substantially self-tapping, said conical threaded portion being adapted for penetrating the spout of a faucet, such that an interior of said housing is in environmental communication with an interior of the spout; and a washer member adapted for providing an environmental seal between the interior of the spout and an external surface of said perimeter side wall;

wherein said housing further comprises a temperature sensing tip adapted for conducting heat from the water flowing through the spout to a said top wall;

wherein said liquid crystal temperature panel further comprises:

a plurality of indicator bands, each one of said plurality of indicator bands becoming visible when heat transferred between the water and said housing exceeds a predetermined limit;

wherein each one of said plurality of indicator bands having a unique color designation corresponding to said predetermined limit; and wherein said liquid crystal temperature panel further comprises:

a plurality of numeric indicia, each one of said plurality of numeric indicia corresponding to said predetermined limit.

* * * * *